US005645009A

United States Patent [19]

Lexau

[11] Patent Number: 5,645,009

[45] Date of Patent: Jul. 8, 1997

[54] POWER BOAT TRIM AUGMENTATION DEVICE

[76] Inventor: James R. Lexau, P.O. Box 44, Herald, Calif. 95638

[21] Appl. No.: 684,808

[22] Filed: Jul. 22, 1996

[51] Int. Cl.[6] ..... B63B 1/24

[52] U.S. Cl. ..... 114/274; 114/280; 114/282

[58] Field of Search ..... 114/144 R, 121, 114/126, 270, 274, 275, 280, 282, 284–286, 145 A, 145 R, 283, 271; 440/51, 53, 61, 900, 66

[56] References Cited

U.S. PATENT DOCUMENTS

| | | | |
|---|---|---|---|
| 3,581,696 | 6/1971 | Ilon | 114/285 |
| 3,965,838 | 6/1976 | Uht . | |
| 5,305,701 | 4/1994 | Wilson | 114/145 A |
| 5,493,990 | 2/1996 | Dyer . | |

OTHER PUBLICATIONS

Bass Pro Shops' 1996 Marine Catalog, p. 36 for hydrofoil and trolling attachments.

*Primary Examiner*—Edwin L. Swinehart
*Attorney, Agent, or Firm*—Lothrop & West

[57] ABSTRACT

Disclosed is a construction applicable to stern drive and outboard types of power boat propulsion units for enhancing the performance normally provided by the customary trim/tilt capabilities designed into the units. At a critical juncture in the trim/tilt operation, the present device automatically "kicks in" and by intercepting only a predetermined portion of the propeller backwash provides an almost immediate stern up/bow down result without noticeable speed retardation. The device lends itself either to kit form or to factory installation.

10 Claims, 7 Drawing Sheets

POWER BOAT TRIM AUGMENTATION DEVICE

BACKGROUND OF THE INVENTION

1. Field of the Invention

The invention relates generally to attachments for conventional, trimmable, stern drive units, which include an external vertical drive portion drivingly interconnected with the engine of a power boat, and for conventional, tiltable outboard motors; and, more particularly, the invention relates to devices for augmenting, or enhancing, the drive trim capabilities of these two widely used types of power boat propulsion units.

2. Prior Art

The market-place is replete with various makes of "hydrofoils" which are designed for attachment to the anticavitation plate of these two main types of propulsion units. Typically, these "foils" are either planar or are somewhat downturned adjacent the trailing edge so as to increase hydrodynamic lift, thereby assisting in elevating the stern of the boat and facilitating getting the boat on plane. See, for example, Bass Pro Shops' 1996 Marine Catalog page 36.

Also available for purchase are trolling attachments which are pivotally mounted on the drive unit and can be selectively positioned either in a horizontal attitude, substantially coplanar with or parallel to the anticavitation plate, or in a vertical attitude in which the attachment receives the full impact of the propeller backwash, thereby retarding forward motion of the boat and, in effect, converting the drive unit to a trolling motor. Examples of such trolling attachments are disclose in Bass Pro Shops' 1996 Marine Catalog, page 36, and in U.S. Pat. No. 3,965,838, and U.S. No. 5,493,990, for example.

SUMMARY OF THE PRESENT INVENTION

Neither the hydrofoils nor the trolling attachments known to applicant either anticipate or render obvious the present invention which serves automatically, at a critical juncture, to augment, or increase, or enhance, the limited drive trim capability designed into the customary vertical drive unit or outboard motor.

In other words, the usual propulsion units afford trimming capabilities provided by a trim pump interconnected with an hydraulic actuator including a trim cylinder and a piston rod projecting from the cylinder. By selectively extending and contracting the piston rod relative to the trim cylinder; the drive unit (stem drive or outboard) is tilted about a transverse horizontal axis.

In a stern drive, a pair of piston rods is pivotally mounted, one on each side of the vertical drive unit, which is itself mounted on a gimbal so as to permit tilting of the lower end of the unit either up or down, relative to the transom, about the transverse horizontal axis. Control of the trim position of the vertical drive unit or outboard is customarily provided by suitable switches within convenient reach of the boat operator. The foregoing components are conventional, long known and need no detailed explanation.

It suffices to say that trimming the lower portion of the vertical drive unit or the outboard down (and forwardly toward the transom) positions the anticavitation plate at an angle such that a vertical component of the hydrodynamic force of the propeller backwash tends to elevate the stern. This urges the bow down, thereby enhancing visibility, passenger comfort, maintaining the boat on plane at reduced throttle settings and increasing top speed. Bow down position also keeps the sharpest part of the hull in the water where it can part the waves in choppy seas and thereby reduce impact.

If hull trim (the attitude of the boat resulting from the weight distribution of people, fuel and gear) is satisfactory, trimming the drive unit down will also help in good weather or bad, to put the boat on plane more quickly, with the attendant advantages of greater fuel economy, maneuverability and stability.

If, on the other hand, hull trim is unsatisfactory, no amount of drive trim will help. Under such circumstances, people and gear must be moved forward. This redistribution of weight in order to improve hull trim is not always convenient or even possible.

In such cases, the drive trim augmentation device of the present invention proves to be of especial value.

In installed position, whether at the factory, or subsequently from a kit, the present invention includes a deflector plate hingeably connected to a mounting plate somewhat larger in surface area than the usual anticavitation plate. The mounting plate is suitably attached to the anticavitation plate and serves to provide initial, additional lift to the stern of the boat (and corresponding downward force on the bow) when the unit is down-trimmed toward the transom. In this respect, the mounting plate initially acts somewhat in the nature of the customary "hydrofoil".

Secured to the top of the deflector plate is a bracket having a pair of walls forming an upstanding channel.

The after end of an adjustable length control rod is pivotally mounted in the opposed channel walls of the bracket and the forward portion of the control rod terminates in a front end or tip, located (in the case of a stern drive installation) in the path of the trim cylinder. The forward portion of the control rod is slidably disposed in an opening in a control rod guide securely mounted on the piston rod of the trim cylinder. The guide serves as a support for the control rod as the control rod tip moves toward and abuts the adjacent end of the cylinder and thereby translates the control rod rearwardly as the drive unit is trimmed down toward the transom.

Rearward, forceful movement of the control rod, in turn, acts through the moment arm of the bracket so as to tilt the deflector plate downwardly into deployed position, intercepting a predetermined portion of the propeller backwash. The hydrodynamic force of the intercepted portion of the propeller back wash impinges against the adjacent forward surface of the deployed deflector plate, inclined in a range of approximately 20 to 25 degrees, and exerts a vertical lift component tending to elevate the drive unit and the stern of the boat. The bow of the boat is correspondingly forced down.

Spring means connecting the mounting plate and the deflector plate provide a convenient and reliable expedient for returning the deflector plate from the angular deployed position to horizontal base position when the drive unit is tilted away from down position and the forward tip of the control rod is no longer in abutment with the end of the trim cylinder.

BRIEF DESCRIPTION OF THE DRAWING FIGURES

The drawing figures illustrate the best mode presently contemplated of carrying out the invention.

DETAILED DESCRIPTION OF THE PREFERRED EMBODIMENT

In power boats under about twenty six feet in length, the customary option is either stem drive or outboard motor with respect to the manner in which the boat is to be powered.

Figure 10:
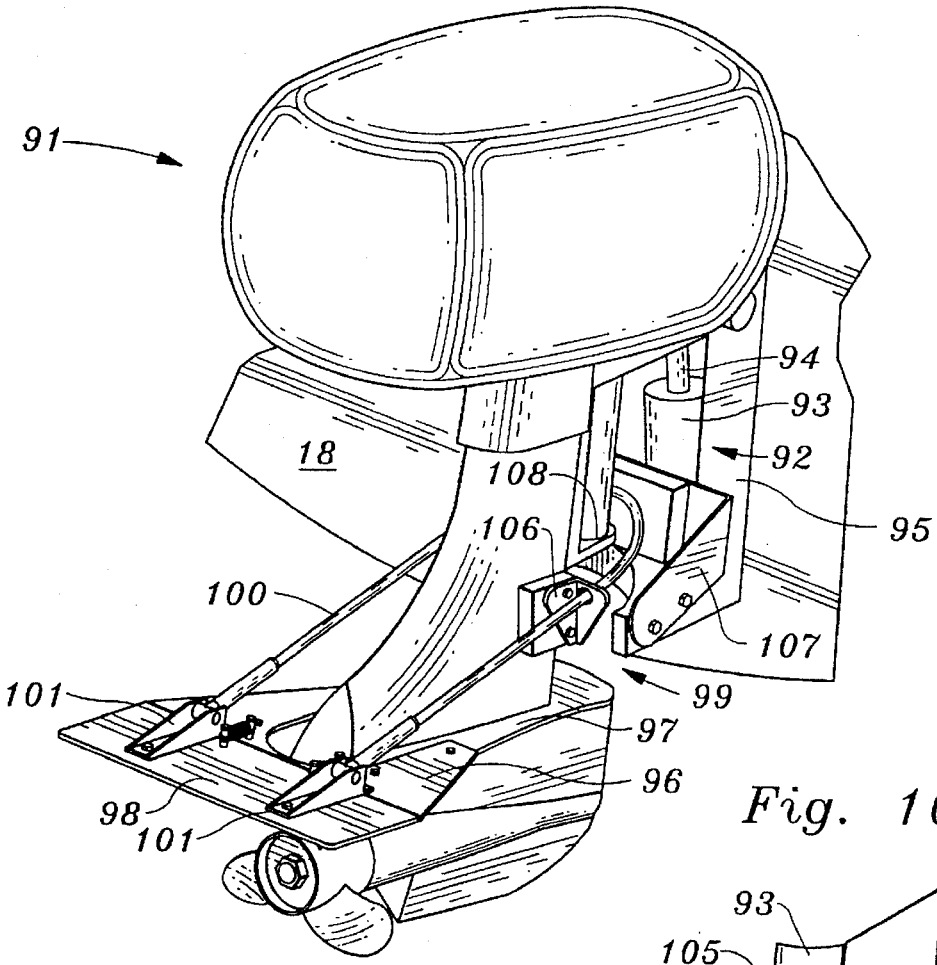
FIG. 10 is a rear perspective view of an outboard motor installed on a transom bracket, showing the trim augmentation device in base position.
Figure 11:
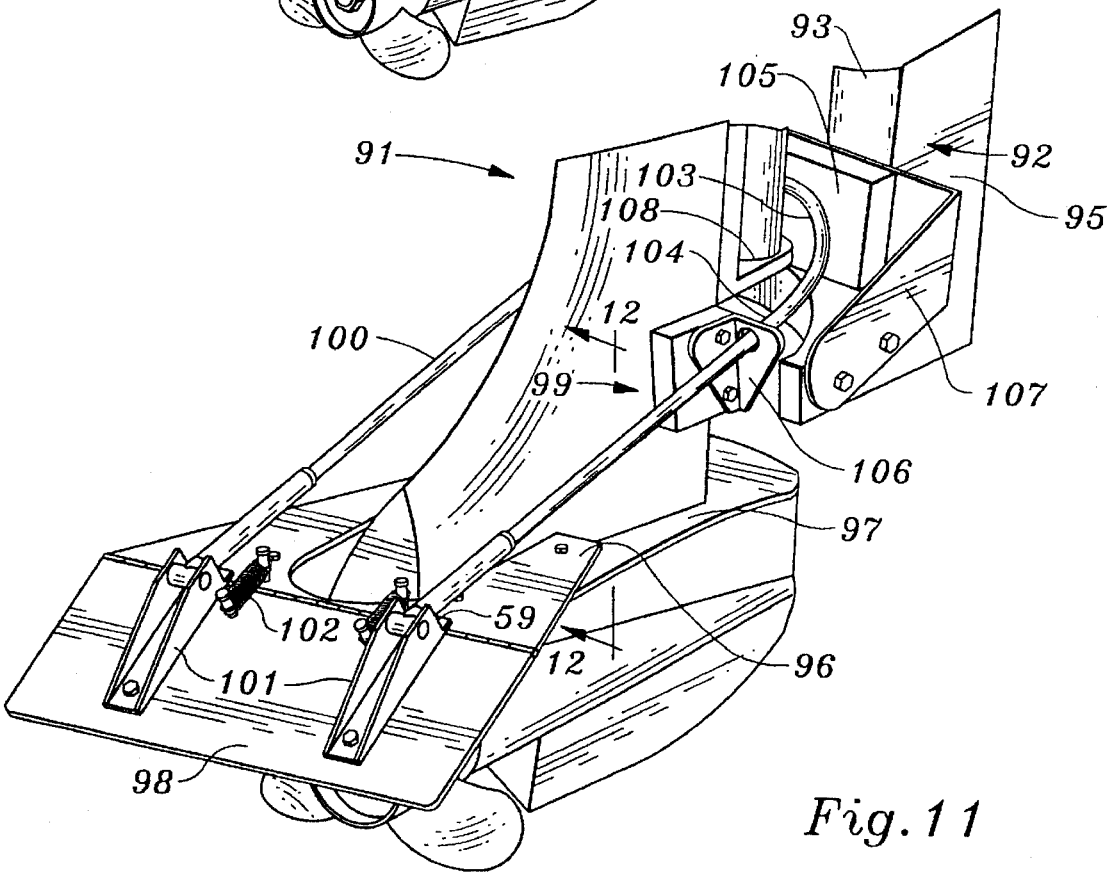
FIG. 11 is a view similar to FIG. 10, but to an enlarged scale, showing the outboard in trim tilt position and with the trim augmentation device in deployed position; and, FIG. 12 is a side elevation of the outboard motor trim augmentation device in base position and showing portions of the outboard's lower gimbal support bushing and transom bracket.
Figure 12:
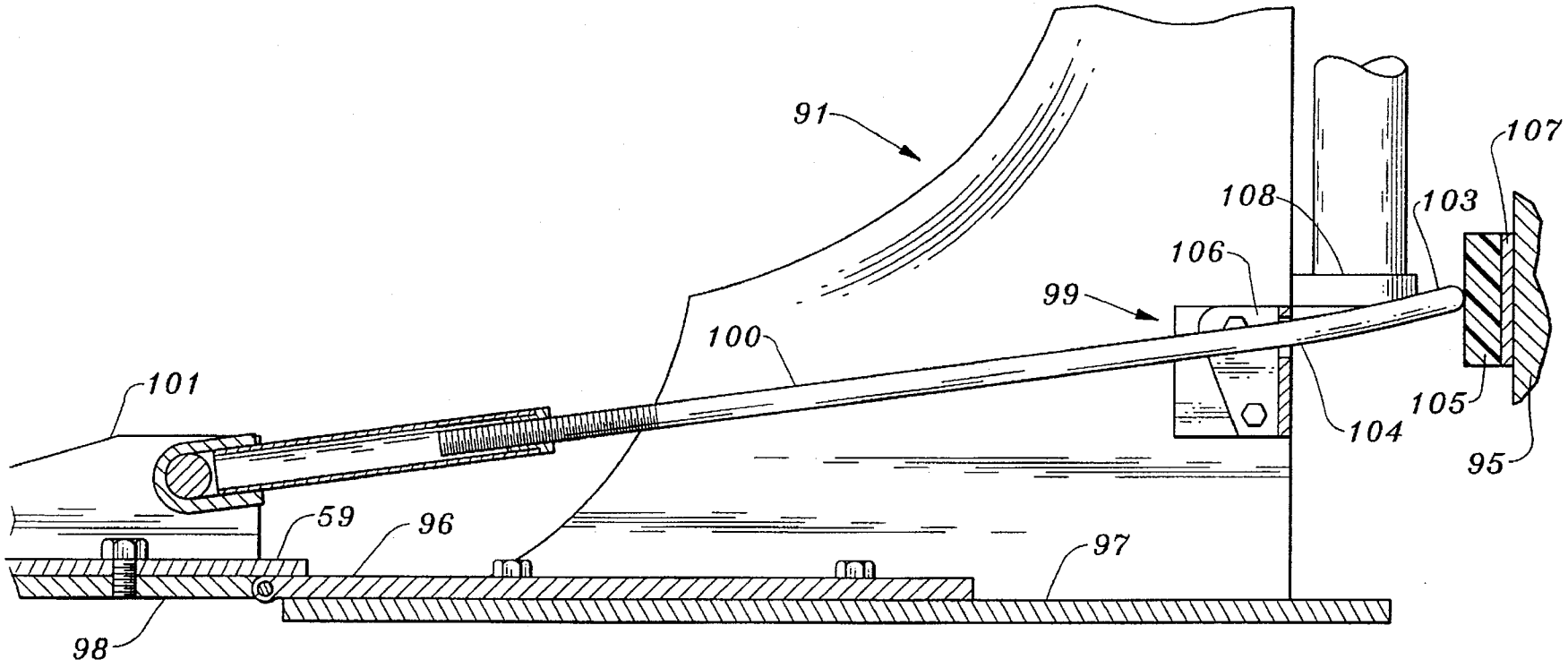

In the present case, the trim augmentation device of the present invention, generally designated by the reference numeral 11, is shown in FIGS. 1–9 as being coupled with a stem drive unit 12 and, more particularly, with a stern drive propulsion unit of the trimmable type, mounted on a power boat 13 under the control of an operator 20. FIGS. 10–12 illustrate an outboard motor installation.

Figure 8:
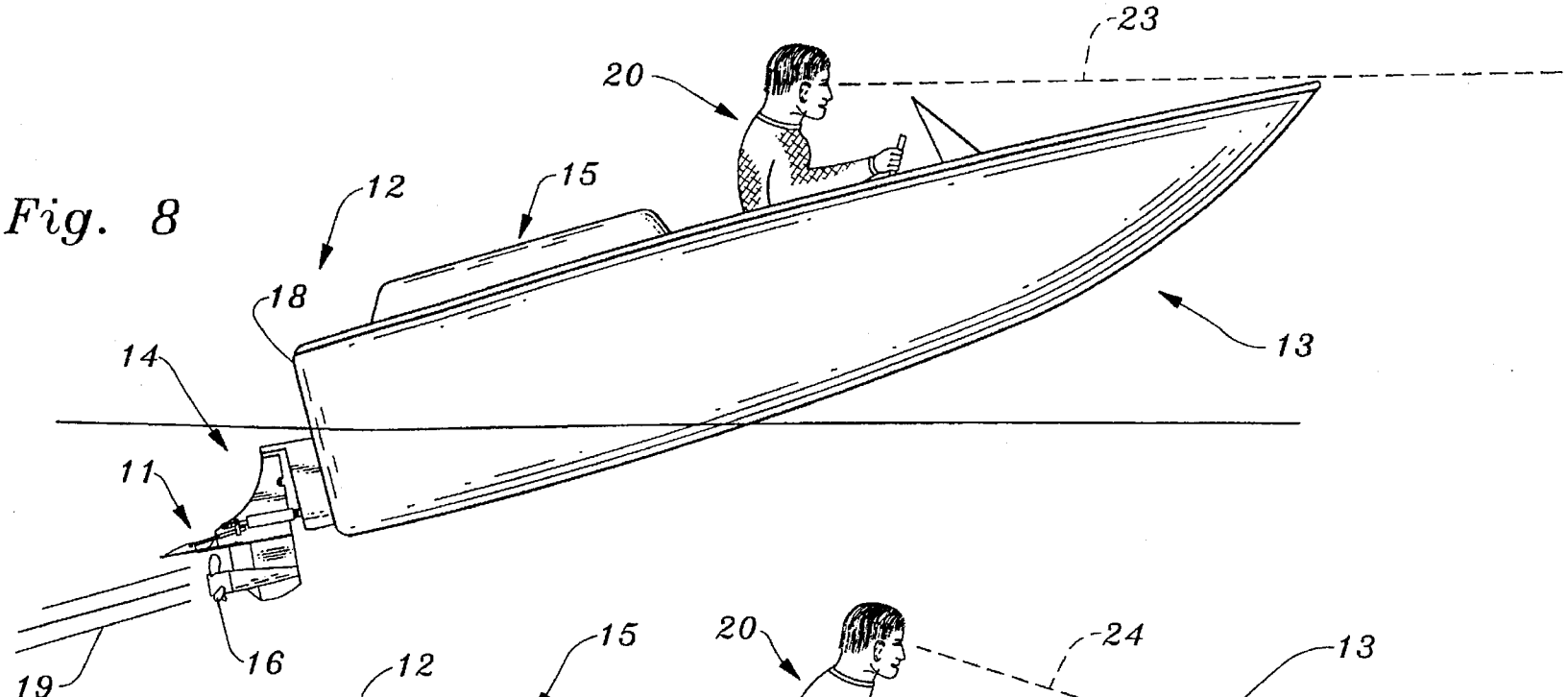
FIG. 8 is a side elevation of a simplified power boat equipped with a trimmable stern drive propulsion unit and fitted with the trim augmenting device, showing the position of the components just prior to actuating the drive trim, the hull trim being such as to elevate the bow of the boat to an undesirable degree.
Figure 9:
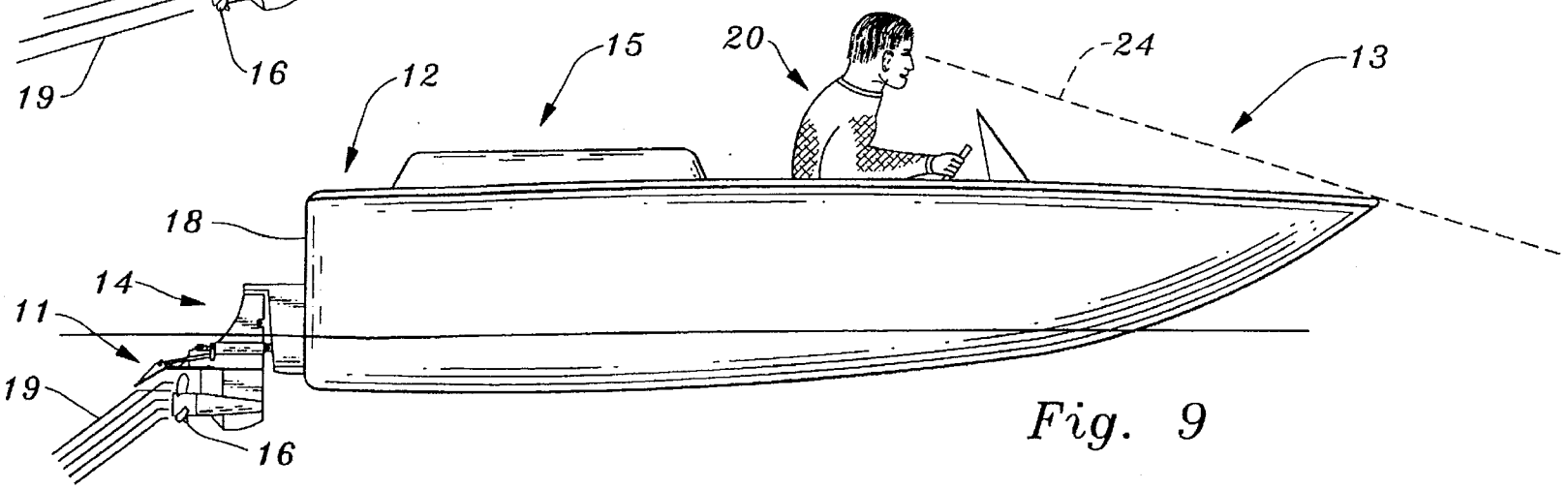
FIG. 9 is a view similar to that of FIG. 8 but showing the boat attitude after the drive trim is trimmed down far enough to actuate the trim augmentation device and deploy the deflector plate of the present invention.

In this connection, it is common practice initially to adjust the "drive trim", i.e. to tilt the external vertical drive portion 14 of the stern drive unit 12 (the internal drive portion being the engine 15 as appears in FIGS. 8 and 9) so that the lower portion of the vertical drive 14, including the propeller 16 and the anticavitation plate 17, are moved downwardly (and forwardly) toward the boat's transom 18.

In well known manner, the anticavitation plate 17 of the vertical drive 14 provides a generally planar surface 21 located above the backwash 19 of the propeller 16 and serves to reduce, or eliminate, the formation of partial vacuums in the water as a result of propeller action, thereby enhancing propulsion efficiency.

The anticavitation plate 17 also provides a moderate amount of "drive trim" capability (elevating the stem and lowering the bow) when the anticavitation plate is inclined so that the after end of the planar surface 21 is at a somewhat lower elevation than the forward end thereof. This inclination is achieved by appropriately tilting the vertical drive, as noted above.

The "drive trim" capability, provided by the interaction between the lower surface 21 of the anticavitation plate 17 and the propeller wash 19, is ordinarily called upon when the throttle is advanced from start position and it is desired to get on plane as quickly as possible. By trimming down the vertical drive 14, the stern of the boat is elevated and the bow is lowered. When there is proper "hull trim", as determined by the weight distribution of people, gear, fuel and supplies, the upward component of the thrust of the propeller backwash 19 on the anticavitation plate 17 ordinarily serves to achieve the desired results.

However, where the "hull trim" is such that the bow is excessively elevated, as a result of improper load distribution, for example, the usual "drive trim" capability is inadequate, resulting in poor visibility, inability to achieve plane and other undesirable characteristics. Contrast the impaired line of sight 23 in FIG. 8 with 24 in FIG. 9.

In this situation, the trim augmentation device of the present invention is automatically actuated and serves quickly to overcome the previous inadequacies, as will now be described.

STERN DRIVE PROPULSION UNITS

In well-known fashion, the external portion of a stern drive unit includes a gimbal housing 26, or bracket, mounted on the transom 18. The gimbal housing 26 provides a protective, shroud-like cover over the forward portion of a vertically elongated gimbal 27. The gimbal 27 is mounted on the housing 26 for pivoting movement about a substantially vertical axis relative to the gimbal housing 26. Axially aligned upper and lower pivot pins 28 provide the rotatable mounting of the gimbal 27 relative to the gimbal housing 26, thereby enabling the vertical drive portion 14 to respond to the boat operator's steering wheel movements to rotate the vertical drive 14 either to port or to starboard, all in conventional manner, to steer the boat in the desired direction.

The gimbal 27 also provides a freedom of motion about a substantially horizontal axis 30, provided by axially aligned port and starboard pivot pins 32 and 31, respectively. The horizontally aligned pins 31 and 32 are mounted on the vertical side walls of the gimbal 27 and provide a pivotal mounting for the pivot housing portion 33 of the vertical drive 14 of the stern drive unit 12. It is about the axis 30 that the vertical drive unit 14 tilts in order to effect the customary "drive trim", i.e. the trim resulting from inclining the anticavitation plate 17, as previously noted.

Tilting movement of the vertical drive unit 14 results from the movement of a pair of hydraulic actuators 36 which are connected to a conventional hydraulic pump-reservoir system (not shown) responsive to command from the operator's station.

The two hydraulic actuators 36 are identical and are mounted in mirror image on opposite, lateral sides of the vertical drive. A description of one actuator 36 will therefore serve to describe the other.

Figure 1:
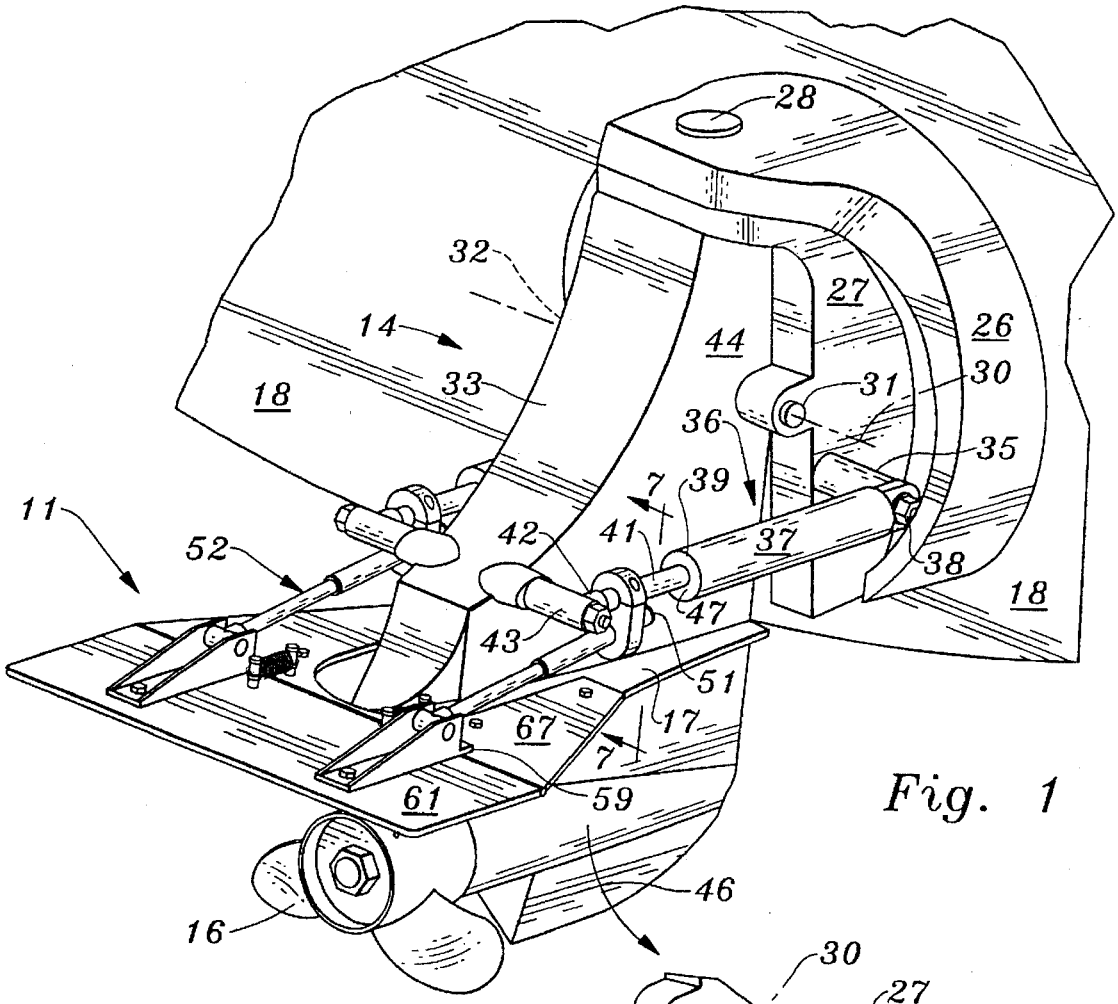
FIG. 1 is a rear perspective view of the portion of a stern drive propulsion unit aft of the power boat's transom, showing the trim augmentation device in base position.
Figure 2:
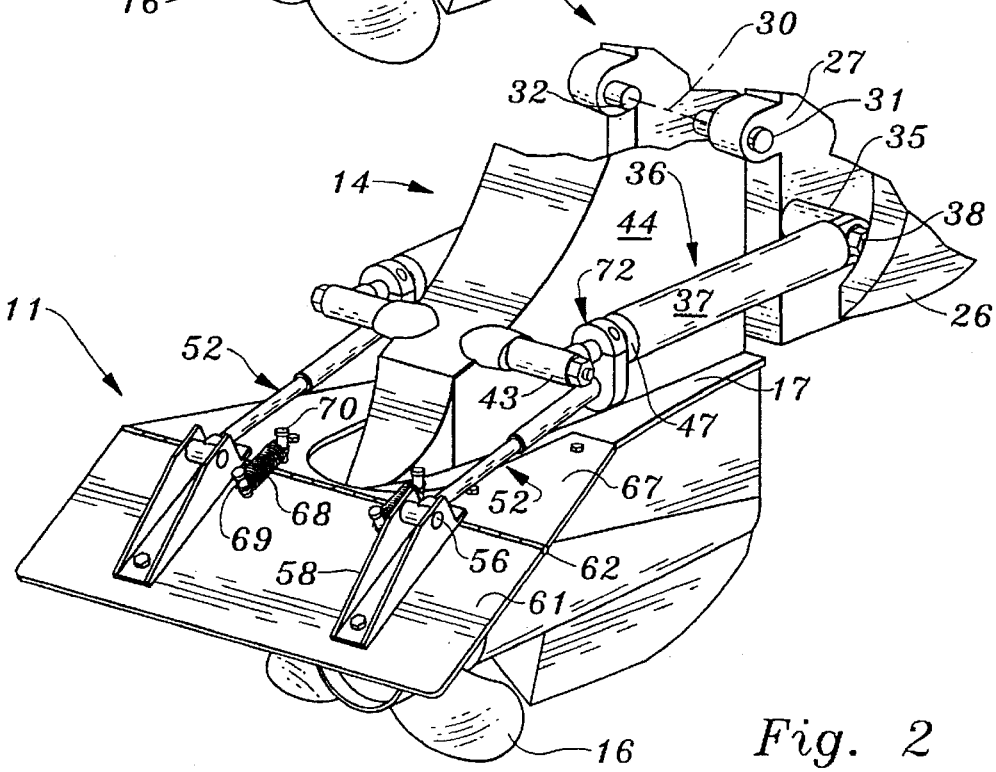
FIG. 2 is a view similar to FIG. 1 but showing the trim augmentation device in deployed position.
Figure 3:
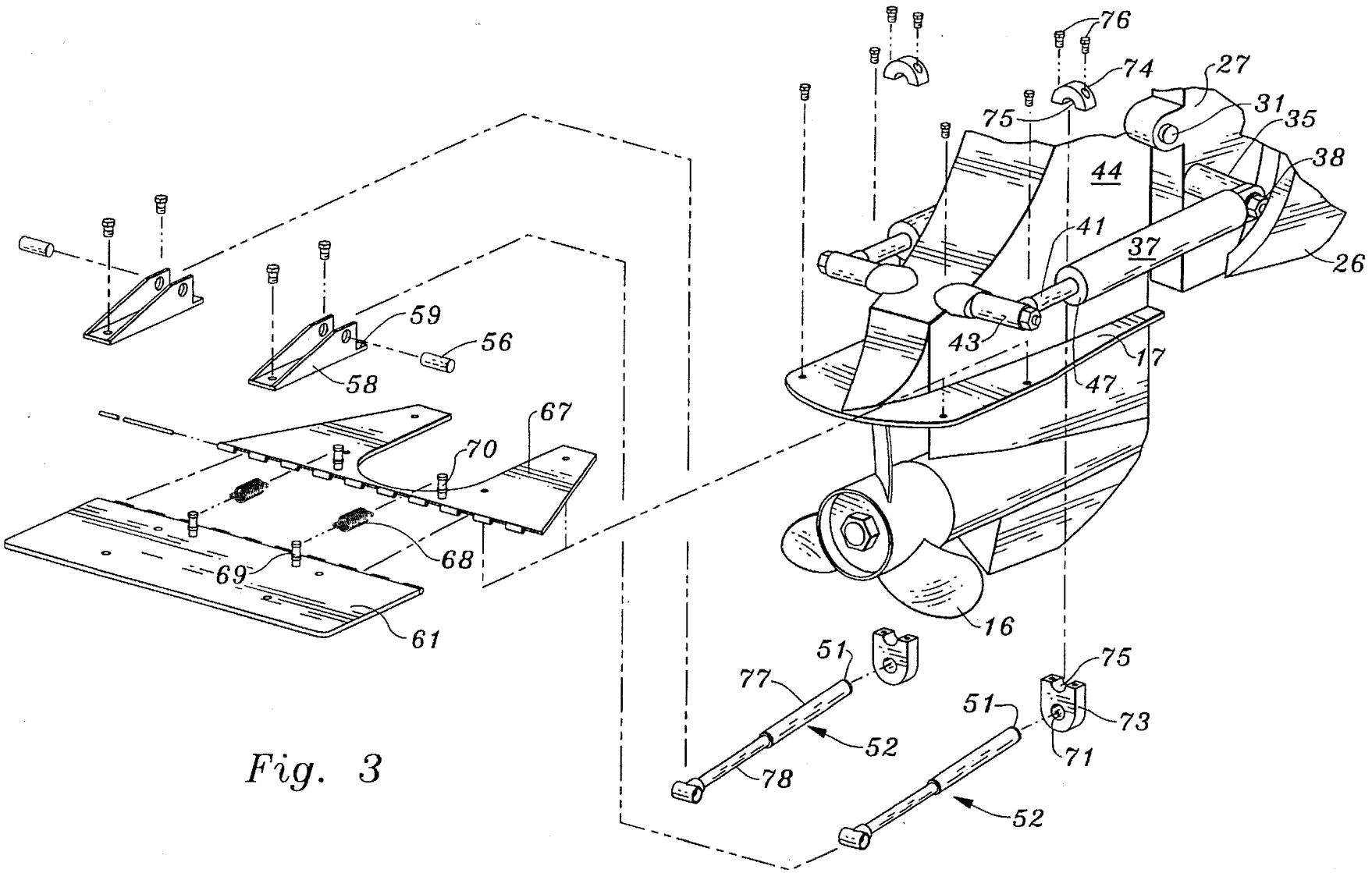
FIG. 3 is an exploded rear perspective view of the lower portion of the propulsion unit and trim augmentation device.

As most clearly appears in FIGS. 1–3, each hydraulic actuator 36 comprises a cylinder 37 pivotally mounted, at its forward end 38, on a bushing 35 projecting from the gimbal 27. Projecting from the after end 39 of the cylinder 37 is a piston rod 41 pivotally mounted at its after end 42 on a bushing 43 secured to the upper gear housing 44 of the vertical drive unit 14. In the interests of clarity, hydraulic hoses and fittings serving to project and retract the piston rod 41 in order to tilt the vertical drive unit 14 are neither shown nor described. Their construction and operation have long been known and used.

It is sufficient to say that when the boat operator 20 manipulates the appropriate switch (not shown) to actuate the hydraulic trim components described above, the piston rod 41 is retracted relative to the cylinder 37, thereby causing the bottom portion of the vertical drive unit 14 to tilt downwardly and forwardly, in a counterclockwise direction, as indicated by the directional arrow 46 in FIG. 1

Inasmuch as the forward end 38 of the cylinder 37 is pivotally connected to the bottom portion of the gimbal 27, which does not partake in the trim movement, retraction of the piston rod 41 also causes all components of the trim augmentation device of the invention 11 to move toward the after end face 47 of the cylinder 37.

Advantage is taken of this relative motion between the components which takes place just as the boat operator tilts the vertical drive in order to improve drive characteristics. In other words, by interposing the forward end 51, or head, of a linear control rod 52 in the path of the adjacent after end face 47 of the cylinder 37, the control rod 52 is urged in an after direction 53 (see FIG. 5) as soon as the head 51, or tip, of the control rod 52 is abutted by the face 47 of the cylinder 37 which is relatively moving in the after direction indicated by the arrow 54.

Linear translation of the control rod 52 in the relative after direction 53 is transmitted to a cross-pin 56 at the after end of the control rod 52. The crosspin 56, in turn, spans the spaced, parallel side walls 57 of a fore and aft elongated bracket 58 mounted on a deflector plate 61. Aided by the moment arm, measured approximately by the distance between the cross pin 56 and a hinge 62 on the leading edge 63 of the deflector plate 61, the deflector plate 61 is rotated in the counterclockwise direction indicated by the arrow 64 in FIG. 5.

The leading edge 63 of the deflector plate 61 is pivotally connected by the hinge 62 to the trailing edge 66 of a mounting plate 67 securely affixed to the anticavitation plate 17.

Tending to urge the deflector plate 61 into coplanar alignment with the mounting plate 67 is a reliable biasing component, such as a tension spring 68 stretching between respective anchor pins 69 and 70, on the deflector plate 61 and the mounting plate 67. A limit stop overhang 59 (see FIG. 5) establishes the base position of deflector plate 61.

Figure 5:
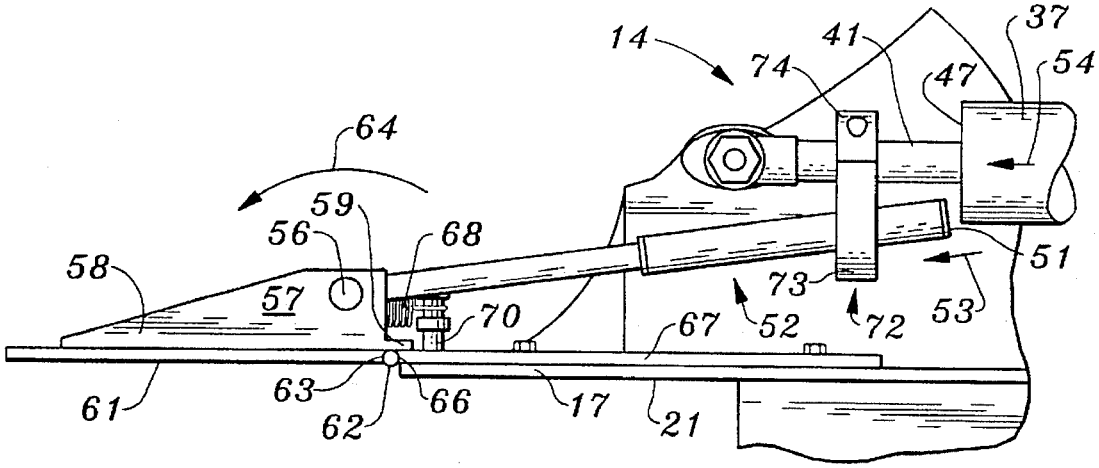
FIG. 5 is a fragmentary side elevation, to an enlarged scale, showing the trim augmentation device in base position.
Figure 6:
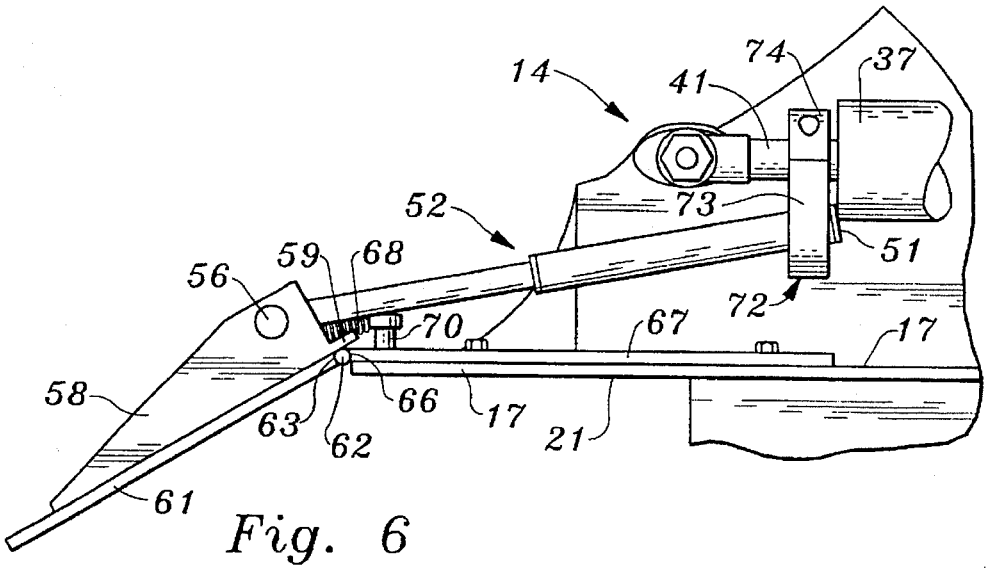
FIG. 6 is a view similar to FIG. 5, but with the trim augmentation device in deployed position.

The control rod 52 extends through and is free to translate in an aperture 71 in a control rod guide 72 (see FIGS. 5 and 6). The guide 72 is releasably secured to the piston rod 41 by a damping structure (best illustrated in FIGS. 3, 5 and 6) in order to adapt the trim augmenting device of the invention to different makes of propulsion units. The control rod guide 72 comprises a lower block 73, in which the aperture 71 is formed, and a cap 74. Matching grooves 75 serve to clamp the piston rod 41 tightly, at any desired longitudinal position on the piston rod 41, when the cap 74 and the lower block 73 are clamped together by fastenings 76 with the piston rod 41 interposed between the cylindrical walls of the matching grooves 75.

Adjustability is also designed into the construction of the control rod 52 so that the effective length can be adjusted to provide the optimum degree of angular displacement of the deflector plate for the particular watercraft and propulsion unit upon which the trim augmentation device 11 is installed, i.e. in the range of about 20° to 25°.

Figure 4:
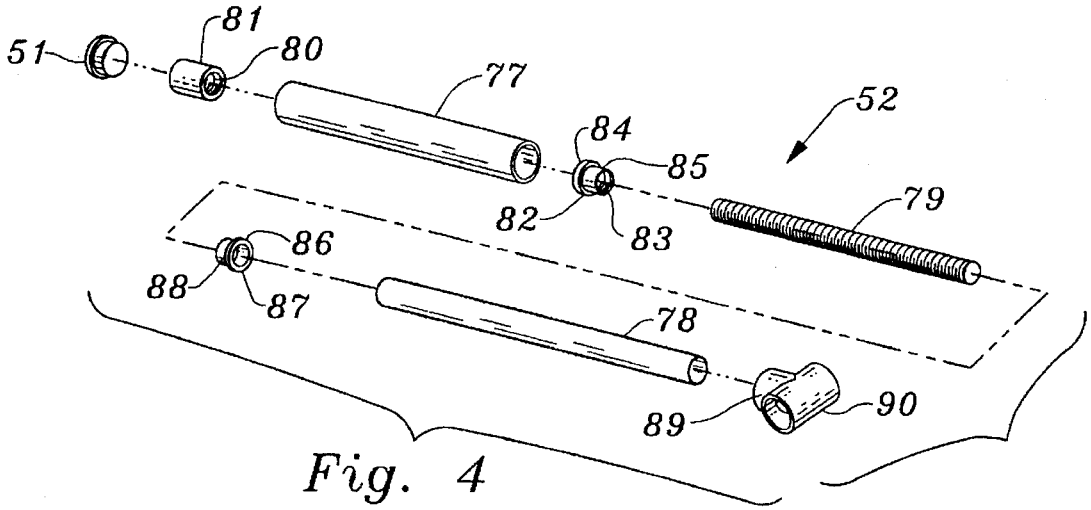
FIG. 4 is an exploded perspective of the adjustable length control rod.
Figure 7:
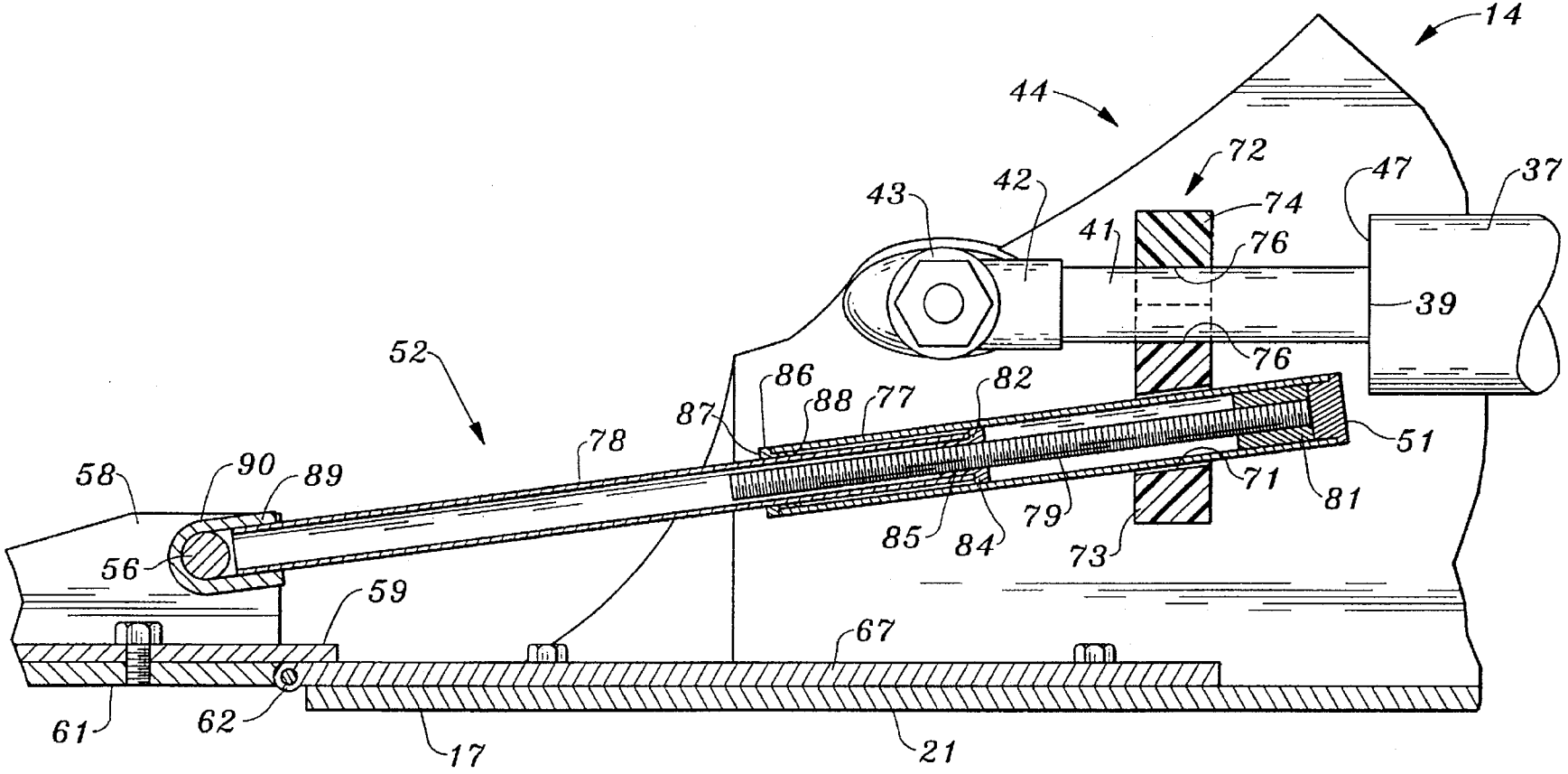
FIG. 7 is a fragmentary longitudinal section, to an enlarged scale, showing the trim augmentation device in base position.

As most clearly appears in FIGS. 4 and 7, the control rod 52 essentially comprises two telescoping tubes, an outer tube 77 and an inner tube 78. Adjustability as to length is afforded by a threaded stem 79, or rod, axially disposed relative to the telescoping tubes 77 and 78.

The forward end 51, or head, or tip, of the control rod 52 is preferably constructed of an impact resistant plastic material and is constructed to provide an interference fit with the adjacent front end of the outer tube 77. Abutting the inner face of the head 51 is a collar 81 with a threaded interior bore 80 (see FIG. 4) which threadably receives the forward end of the threaded stem 79 and provides an anchor for the threaded stem 79.

The forward end of the inner tube 78 preferably extends well into the outer tube 77 (see FIG. 7) and is threadably connected to the threaded stem 79 by a plug 82 having internal threads 83 engageable with the stem threads. The plug 82 includes a shoulder 84 having an outer diameter such as to form a snug, but not an interference, fit with the internal diameter of the outer tube 77. The shank portion 85 of the plug 82 has an outer diameter providing an interference fit with the internal diameter of the inner tube 78 and the forward end of the inner tube 78 abuts the plug shoulder 84.

The after end of the outer tube 77 abuts the shoulder 86 of a bushing 87, the bushing 87 including a tubular shank 88 having an outer diameter wall providing an interference fit with the inner diameter wall of the outer tube 77 and a snug fit with the outer diameter wall of the inner tube 78. The bushing 87 is preferably of plastic material.

The after end of the inner tube 78 is attached to the leg 89 of the T-shaped fitting 90 housing the cross-pin 56.

With the control rod construction as just described, the outer tube 77, the threaded stem-anchoring collar 81, the plastic tip 51 and the threaded stem 79 remain fixed during lengthening or shortening of the control rod 52. Rotation of the tee 90 also rotates the inner tube 78 as well as the internally threaded plug 82, thereby changing the overall length of the control rod 52 in dependence upon the direction of rotation of the tee 90. The plastic bushing 87 remains in place and serves to retain the telescoping tubes in proper alignment, i.e. concentric relative to the threaded stem.

In commercial practice, the length of the control rod 52 will in most cases be fixed, the length being selected to suit various sizes of propulsion units. In kits, however, adjustability of control rod length is very desirable.

OUTBOARD MOTOR PROPULSION UNITS

Outboard motors have been in use as long as or longer than stem drives. Similar in several ways to stern drives, outboards also include anticavitation plates, propellers and gimbal means for providing steering capabilities (rotation about a vertical axis) as well as trimming and tilting capabilities (rotation about a transverse horizontal axis).

In outboards 91, positioning for trimming and towing is usually effected by a single hydraulic actuator 92 (cylinder 93 and piston rod 94) mounted centrally on a transom bracket 95, in well known manner.

Inasmuch as trim is of particular interest in the present invention, steering and towing capabilities will be described only as they relate to enhancing trimming (i.e. elevating the stern and lowering the bow in order to overcome unsatisfactory hull trim resulting from improper weight distribution of passengers, gear etc.)

As in the case of the stern drive unit, the outboard installation includes a mounting plate 96 secured to the customary anticavitation plate 97. Hingeably mounted on the trailing edge of the mounting plate 96 is a deflector plate 98 and serving to urge the deflector plate from a base position, co-planar with the mounting plate 96, to a deployed position intercepting a predetermined portion only of the propeller backwash, is a deployment mechanism, generally designated by the reference numeral 99.

As before, the mechanism 99 includes a pair of fore and aft control rods 100 pivotally mounted at their after ends on brackets 101 secured to the top surface of the deflector plate 98. Biasing the deflector plate 98 into co-planar relation with the mounting plate 96 is a pair of tension springs 102 connecting the deflector plate 98 and the mounting plate 96.

From this point on, the deployment mechanism 99 of the outboard differs in details from that disclosed in the stern drive installation. However, the identical principles apply, namely, that as drive trim is effectuated by tilting the bottom of the unit downwardly and toward the transom, rearward force is applied to the control rods at a predetermined point in the trim operation and continues to be applied until the angular displacement of the deflector plate has reached the desired degree.

In the case of an outboard, the rearward force on the two control rods 100 is exerted by the impingement of a semi-circular connector 103, or horseshoe, joining the forward ends 104 of the control rods 100 against a stationary impact block 105 affixed to the transom bracket 95.

Positioning of the control rods 100 in a forward and upward attitude is a pair of control rod guides 106 mounted on opposite lateral sides of the outboard 91. Suitable apertures in the guides 106 allow free fore and aft motion of the control rods 100.

As clearly appears in FIGS. 10–12, the impact block 105 is so mounted on a fixture 107 attached to the transom bracket 95 that the block 105 confronts the adjacent arcuate portion of the semi-circular connector 103, or horseshoe, which has a center substantially coincident with the vertical, or steering axis of the outboard's lower gimbal support bushing 108, which itself has an external forward surface of a semi-cylindrical nature.

Prior to effectuating drive trim, the deflector plate 98 is co-planar with the mounting plate 96, by virtue of the tension springs 102, and the overhang limit stop 59; and the horseshoe 103 is substantially concentric with, although spaced slightly forwardly from, the adjacent external forward surface of the lower gimbal support bushing 108.

As drive trim is commenced, as a result of operation of the hydraulic actuator 92, and the outboard is tilted about the horizontal (trimming and towing) axis so that the forward margin of the horseshoe 103 approaches and then abuts the impact block 105, rearward force is applied to the control rods 100 (just as in the case of the stern drive trim where the control rods 52 abutted the aft facing ends 47 of the cylinders 37). The rearward force of the control rods 100 acts through the moment arm provided by the upstanding brackets 101 to deploy the deflector plate 98. The dimensions of the components are selected so that at maximum deployment, the angular inclination of the deflector plate is preferably in the range of approximately 20° to 25°.

With the deflector plate in deployed position, intercepting a given portion only of the propeller backwash, the customary drive trim is substantially and most beneficially enhanced.

Owing to the practically concentric arrangement of the horseshoe 103 and the lower gimbal support bushing 108 or, more specifically, to the fact that the center of the horseshoe 103 is substantially coincident with the vertical steering axis when the horseshoe 103 is in abutment with the impact block 105, it follows that the outboard can be steered throughout its entire port-starboard range while the deflector plate is deployed to its maximum desired extent. In other words, with the forward margin of the horseshoe 103 in abutment with the adjacent portion of the aft facing surface of the impact block 105, steering from one heading to another merely causes the forward margin of the horseshoe 103 to "roll across" the adjacent surface of the impact block 105 in a horizontal path. All the while, equal rearward force is exerted by the horseshoe 103 on both of the control rods 100 and on the deployed deflector plate 98, holding the deflector plate 98 in fully deployed position. Smooth, wear-resistant, rolling contact along the horizontal path is obtained by fabricating the impact block 105 from Nylon®, or the like.

OPERATION

Although FIGS. 8 and 9 illustrate a power boat with stern drive installation, substantially the same interaction between the deflector plate 61 and the propeller backwash 19 occurs in both stem drives and outboards provided with the trim augmentation device of the present invention.

Generally speaking, when the propulsion unit of a power boat is initially actuated, the force of the forward thrust passes below the boat's center of gravity with a moment arm tending to elevate the bow toward the attitude shown in FIG. 8.

The backwash 19, shown schematically in FIG. 8, usually, provides only a relatively small upward force component on the bottom surface of the anticavitation plate, ordinarily making it necessary for the operator to utilize the drive trim capability designed into both types of propulsion units in order to achieve optimum performance.

The use of the drive trim involves, as previously explained, the rotation of the drive unit about a horizontal transverse axis so as to move the bottom portion of the drive unit downwardly and forwardly. The effect is to reduce the extent of the moment arm and increase the upward force on the anticavitation plate, thereby tending to elevate the stern and lower the bow.

When it is desired, however, to cruise at a speed critical to plane or less than that required to maintain an "on plane" condition, or to overcome the adverse consequences of improper hull trim resulting from incorrect load distribution, all too often the available drive trim adjustment is inadequate, by itself.

With the present trim-augmentation device installed, the movement of the drive trim beyond a predetermined position, determined by experimentation with the particular power boat and propulsion unit involved, causes the deflector plate to move from a neutral, or base, position, in line with the anticavitation plate, to a deployed angular position. In its deployed position, the deflector plate intercepts a top portion only of the backwash, as appears in FIG. 9, redirecting the backwash angularly downwardly and, by reaction, elevating the stem and lowering the bow.

It can therefore be seen that the performance of propulsion units of either the stem drive or outboard type can be improved by the installation of the trim augmentation device of the invention as shown and described herein.

I claim:

1. In a power boat propulsion unit pivotally mounted on a transom bracket for rotation about a substantially vertical axis for steering and a substantially horizontal axis for trimming and tilting, the unit including a propeller and an anticavitation plate, a trim augmentation device comprising:

a. a mounting plate attached to the anticavitation plate, said mounting plate extending from a front end to a rear end;

b. a deflector plate extending from a forward end to an after end;

c. hinge means for connecting said forward end of said deflector plate to said rear end of said mounting plate for movement between a base position in which said deflector plate is substantially coplanar with said mounting plate and a deployed position in which said deflector plate is angularly inclined to intercept a predetermined portion only of the propeller backwash in forward operating mode of the propulsion unit; and, d. means for urging said deflector plate toward said deployed position in dependence upon the extent of trim rotation of the unit about the horizontal axis.

2. A trim augmentation device as in claim 1 including means for biasing said deflector plate toward said base position.

3. A trim augmentation device as in claim 2 in which said biasing means includes a tension spring mounted at one end on said mounting plate and at the other end on said deflector plate.

4. A trim augmentation device as in claim 1 in which the propulsion unit is a stem drive in which trim rotation of the unit about the horizontal axis is effected by a hydraulic actuator including a cylinder and a piston rod, and in which said deflector plate urging means includes a control rod extending between a trailing end pivotally mounted on said deflector plate and a leading end oriented in a forward direction, said control rod having a predetermined attitude and length such that said leading end is disposed in the path of the cylinder and is abutted thereby as trim rotation of the unit about the horizontal axis moves said leading end toward and into contact with the cylinder, thereby deploying the deflector plate.

5. A trim augmentation device as in claim 4 including a control rod guide mounted on the piston rod, said control rod guide having an opening through which said control rod is freely translatable as trim rotation occurs.

6. A trim augmentation device as in claim 5 in which the stern drive includes an engine located inboard and an external vertical drive mounted on a gimbal for trim rotation about the horizontal axis, the gimbal being mounted on the transom bracket for steering rotation about a vertical axis, and in which trim rotation about the horizontal axis is effected by a pair of cylinders and piston rods each disposed on opposite sides of the vertical drive in mirror symmetry, said trim augmentation device including means for adjusting the length of said control rods so that at maximum deployment the angular displacement of said deflector plate relative to said mounting plate is in a range of approximately twenty to twenty five degrees.

7. A trim augmentation device as in claim 2 in which the propulsion unit is an outboard motor and said deflector plate urging means includes a pair of control rods each being mounted on a lateral side of the outboard motor and extending forwardly from trailing ends pivotally mounted on said deflector plate to respective leading ends, a semi-circular control rod connector joining said leading ends of said control rods, said connector having a center substantially coincident with the substantially vertical steering axis of the outboard motor, an impact block mounted on the transom bracket for abutment with said connector as trim rotation of the unit about the horizontal axis moves said control rod connector toward and into contact with said impact block, thereby forcing said pair of control rods in an after direction and deploying said deflector plate in opposition to said deflector plate biasing means.

8. A trim augmentation device as in claim 7 including a pair of control rod guides having apertures through which said pair of control rods extends, said control rod guides being mounted on opposite lateral sides of the outboard motor for guiding the respective control rod.

9. A trim augmentation device as in claim 8 in which said deflector plate biasing means includes a tension spring mounted at one end on said mounting plate and at the other end on said deflector plate.

10. A trim augmentation device as in claim 9 in which said semi-circular connector encompasses the lower gimbal support bushing of the outboard motor in spaced relation, said connector being movable between a first location spaced from said impact block and a second location in abutment with said impact block in dependence upon the extent of trim rotation, the contours of said impact block and the adjacent margin of said connector cooperating during steering rotation of the unit with said connector in said second location to maintain equal rearward force on each of said control rods, said impact block being of wear-resistant, low-friction-coefficient material.

* * * * *

UNITED STATES PATENT AND TRADEMARK OFFICE

CERTIFICATE OF CORRECTION

PATENT NO. : 5,645,009

DATED : July 8, 1997

INVENTOR(S) : James R. Lexau

It is certified that error appears in the above-identified patent and that said Letters Patent is hereby corrected as shown below:

Column 3, line 41, change "stem" to --stern--
Column 3, line 46, change "stem" to --stern--
Column 3, line 65, change "stem" to --stern--
Column 8, line 21, change "stem" to --stern--
Column 8, line 57, change "stem" to --stern--
Column 8, line 59, change "stem" to --stern--
Column 9, line 25, change "stem" to --stern--

Signed and Sealed this

Twenty-fifth Day of November, 1997

*Attest:*

Bruce Lehman

BRUCE LEHMAN

*Attesting Officer*

*Commissioner of Patents and Trademarks*